US010619645B2

(12) United States Patent
Daussin et al.

(10) Patent No.: US 10,619,645 B2
(45) Date of Patent: Apr. 14, 2020

(54) CENTRIFUGAL COMPRESSOR HAVING AN INTER-STAGE SEALING ARRANGEMENT

(71) Applicant: DANFOSS COMMERCIAL COMPRESSORS, Trevoux (FR)

(72) Inventors: Arnaud Daussin, Saint Germain au Mont D'or (FR); Patrice Bonnefoi, Saint Didier au Mont D'or (FR); Nicolas Nouyrigat, Lyons (FR)

(73) Assignee: Danfoss A/S, Nordborg (DK)

( * ) Notice: Subject to any disclaimer, the term of this patent is extended or adjusted under 35 U.S.C. 154(b) by 186 days.

(21) Appl. No.: 15/735,301

(22) PCT Filed: Jun. 20, 2016

(86) PCT No.: PCT/EP2016/064160
§ 371 (c)(1),
(2) Date: Dec. 11, 2017

(87) PCT Pub. No.: WO2017/005477
PCT Pub. Date: Jan. 12, 2017

(65) Prior Publication Data

US 2018/0142694 A1 May 24, 2018

(30) Foreign Application Priority Data

Jul. 7, 2015 (FR) ..... 15 56410

(51) Int. Cl.
*F04D 29/10* (2006.01)
*F04D 29/28* (2006.01)
(Continued)

(52) U.S. Cl.
CPC ..... *F04D 29/102* (2013.01); *F04D 17/12* (2013.01); *F04D 29/051* (2013.01);
(Continued)

(58) Field of Classification Search
CPC .... F04D 29/102; F04D 29/051; F04D 29/056; F04D 29/286; F04D 17/12; F04D 17/122
See application file for complete search history.

(56) References Cited

U.S. PATENT DOCUMENTS 6,834,501 B1 * 12/2004 Vrbas ..... F01D 5/045 123/562
7,407,364 B2 * 8/2008 Arnold ..... F01D 9/026 415/100
(Continued)

FOREIGN PATENT DOCUMENTS

CN 1042758 A 6/1990
CN 202937467 U 5/2013
(Continued)

OTHER PUBLICATIONS

International Search Report for PCT Serial No. PCT/EP2016/064160 dated Jul. 28, 2016.

*Primary Examiner* — Dwayne J White
*Assistant Examiner* — Jackson N Gillenwaters
(74) *Attorney, Agent, or Firm* — McCormick, Paulding & Huber PLLC

(57) ABSTRACT

The centrifugal compressor includes an hermetic housing; a drive shaft (4); a first and a second compression stage (8, 9) configured to compress a refrigerant, the first and second compression stages (8, 9) respectively including a first and a second impeller (18, 19), the first and second impellers (18, 19) being connected to the drive shaft (4) and being arranged in a back-to-back configuration; a radial annular groove (27) formed between the back-sides (25, 26) of the first and second impellers (18, 19); an inter-stage sealing arrangement (35) provided between the first and second compressor stages (8, 9) and in the radial annular groove (27); a radial bearing arrangement configured to rotatably support the drive shaft (4); and a thrust bearing arrangement
(Continued)

configured to limit an axial movement of the drive shaft (4) during operation. The diameter of the inter-stage sealing arrangement (35) is configured to minimize the amplitude of the axial load applying on the thrust bearing arrangement during operation of the centrifugal compressor (2).

19 Claims, 3 Drawing Sheets

(51) Int. Cl.

| | |
|---|---|
| ***F04D 17/12*** | (2006.01) |
| ***F04D 29/051*** | (2006.01) |
| ***F04D 29/056*** | (2006.01) |
| *F04D 25/06* | (2006.01) |
| *F04D 29/053* | (2006.01) |

(52) U.S. Cl.
CPC ..... *F04D 29/056* (2013.01); *F04D 29/286* (2013.01); *F04D 17/122* (2013.01); *F04D 25/06* (2013.01); *F04D 29/053* (2013.01)

(56) References Cited

U.S. PATENT DOCUMENTS

| | | | | |
|---|---|---|---|---|
| 7,568,883 | B2 * | 8/2009 | Arnold | F04D 17/122 415/100 |
| 9,879,690 | B2 * | 1/2018 | Griffin | F04D 29/0516 |
| 2013/0195609 | A1 * | 8/2013 | Mariotti | F04D 29/057 415/1 |
| 2015/0267717 | A1 * | 9/2015 | Fujii | F04D 19/002 415/220 |
| 2017/0234213 | A1 * | 8/2017 | Futae | F02B 39/14 415/110 |

FOREIGN PATENT DOCUMENTS

| | | | | |
|---|---|---|---|---|
| DE | 18 03 958 | A1 | 6/1969 | |
| DE | 30 41 093 | A1 | 6/1982 | |
| JP | 5722673 | B2 * | 5/2015 | F04D 17/125 |
| WO | 2012/124293 | A1 | 9/2012 | |

* cited by examiner

CENTRIFUGAL COMPRESSOR HAVING AN INTER-STAGE SEALING ARRANGEMENT

CROSS-REFERENCE TO RELATED APPLICATIONS

This application is a National Stage application of International Patent Application No. PCT/EP2016/064160, filed on Jun. 20, 2016, which claims priority to French Patent Application No. 1556410, filed on Jul. 7, 2015, each of which is hereby incorporated by reference in its entirety.

TECHNICAL FIELD

The present invention relates to a centrifugal compressor, and in particular to a two-stage centrifugal compressor.

BACKGROUND

WO2012124293 discloses a two-stage centrifugal compressor including notably:

an hermetic housing, a drive shaft rotatably arranged within the hermetic housing, a first and a second compression stage configured to compress a refrigerant, the first and second compression stages respectively including a first and a second impeller, the first and second impellers being connected to the drive shaft and being arranged in a back-to-back configuration, a radial annular groove formed between the back-sides of the first and second impellers, an inter-stage sealing arrangement provided between the first and second compressor stages and in the radial annular groove, a radial bearing arrangement configured to rotatably support the drive shaft, and a thrust bearing arrangement configured to limit an axial movement of the drive shaft during operation.

During operation of such a two-stage centrifugal compressor, the axial loads applied on the thrust bearing arrangement are high, which requires the provision of a large thrust bearing arrangement to withstand the axial loads applied on the latter. This results in a centrifugal compressor having high power consumption.

SUMMARY

It is an object of the present invention to provide a centrifugal compressor which can overcome the drawbacks encountered with conventional centrifugal compressors.

Another object of the present invention is to provide a centrifugal compressor having a thrust bearing arrangement of reduced size and thus having a low power consumption.

According to the invention such a centrifugal compressor includes:

an hermetic housing, a drive shaft rotatably arranged within the hermetic housing, a first and a second compression stage configured to compress a refrigerant, the first and second compression stages respectively including a first and a second impeller, each of the first and second impellers having a front-side and a back-side, the first and second impellers being connected to the drive shaft and being arranged in a back-to-back configuration, a radial annular groove formed between the back-sides of the first and second impellers, a circular inter-stage sealing arrangement provided between the first and second compressor stages and in the radial annular groove, a radial bearing arrangement configured to rotatably support the drive shaft, and a thrust bearing arrangement configured to limit an axial movement of the drive shaft during operation, wherein the diameter of the inter-stage sealing arrangement is configured to minimize the amplitude of the axial load applying on the thrust bearing arrangement during operation of the centrifugal compressor.

Such a configuration of the inter-stage sealing arrangement, and particularly of its diameter, allows the provision of a thrust bearing arrangement of reduced size, and thus to reduce the power consumption of the centrifugal compressor. These provisions allow therefore to increase the efficiency of the centrifugal compressor.

The centrifugal compressor may also include one or more of the following features, taken alone or in combination.

According to an embodiment of the invention, the diameter of the inter-stage sealing arrangement is configured such that the absolute value of the axial thrust load occurring during any operational conditions of the centrifugal compressor is minimal.

According to an embodiment of the invention, the minimal diameter of the inter-stage sealing arrangement is less than half of the outer diameter of the first impeller and is less than half of the outer diameter of the second impeller.

According to an embodiment of the invention, the ratio between the outer diameter of the first impeller and the minimal diameter of the inter-stage sealing arrangement is higher than 2.5, and the ratio between the outer diameter of the second impeller and the minimal diameter of the inter-stage sealing arrangement is higher than 2.5.

According to an embodiment of the invention, the minimal diameter of the inter-stage sealing arrangement is smaller than the outer diameter of the portion of the drive shaft rotatably supported by the radial bearing arrangement.

According to an embodiment of the invention, the centrifugal compressor further includes a separating member connected to the hermetic housing, the separating member having a disc shape and being at least partially arranged within the radial annular groove, the inter-stage sealing arrangement being formed by an inner peripheral surface of the separating member and a circumferential bottom surface of the radial annular groove.

According to an embodiment of the invention, the separating member has a first axial wall surface and a second axial wall surface opposite to the first axial wall surface, the first axial wall surface and the back-side of the first impeller defining a first axial gap and the second axial wall surface and the back-side of the second impeller defining a second axial gap.

According to an embodiment of the invention, the inner peripheral surface of the separating member and the circumferential bottom surface of the radial annular groove define a radial gap. The presence of a certain axial gap (and hence a certain volume) between the separating member and the first and second impellers ensures stable pressure conditions within the radial annular groove, especially if the absolute dimensions are very small.

According to an embodiment of the invention, the width of the first axial gap is at least twice the width of the radial gap, and the width of the second axial gap is at least twice the width of the radial gap.

According to an embodiment of the invention, each of the first and second axial gaps may be between 1 and 10% of the outer diameter of the first impeller, and may be between 1 and 10% of the outer diameter of the second impeller.

According to an embodiment of the invention, each of the first and second axial gaps may be between 140 and 150 μm, and is for example about 150 μm.

Advantageously, each of the first and second axial gaps is larger than the maximum allowed axial movement of the drive shaft during operation of the centrifugal compressor.

According to an embodiment of the invention, the radial gap may be between 0.1 and 2% of the outer diameter of the first impeller, and may be between 0.1 and 2% of the outer diameter of the second impeller.

According to an embodiment of the invention, the radial gap may be between 40 and 50 μm.

According to an embodiment of the invention, the hermetic housing includes a low pressure chamber located upstream the first compression stage, a high pressure chamber located downstream the second compression stage, and an intermediate pressure chamber provided between a fluid outlet of the first compression stage and a fluid inlet of the second compression stage.

According to an embodiment of the invention, the circular inter-stage sealing arrangement is configured to minimize or control fluid flow from the high pressure chamber to the intermediate pressure chamber.

According to an embodiment of the invention, the radial bearing arrangement and the thrust bearing arrangement are arranged in the low pressure chamber.

According to an embodiment of the invention, the circular inter-stage sealing arrangement is a labyrinth sealing arrangement.

According to an embodiment of the invention, the outer diameters of the first and second impellers are substantially equal.

Advantageously, the ratio between the outer diameter of the first impeller and the outer diameter of the second impeller is between 0.8 and 1.2, or between 0.9 and 1.1.

According to an embodiment of the invention, the drive shaft includes a first axial end portion, a second axial end portion and an intermediate portion arranged between the first and second end axial portions.

According to an embodiment of the invention, the first and second impellers are connected to the first axial end portion of the drive shaft.

According to an embodiment of the invention, the centrifugal compressor further includes a driving device configured to drive in rotation the drive shaft about a rotation axis, the radial bearing arrangement and the thrust bearing arrangement being located between the driving device and the first compression stage.

According to an embodiment of the invention, the driving device is an electrical motor including a stator and a rotor. Advantageously, the rotor is connected to the second axial end portion of the drive shaft.

According to an embodiment of the invention, the driving device includes at least one turbine impeller.

According to an embodiment of the invention, the driving device is arranged in the low pressure chamber.

According to an embodiment of the invention, the thrust bearing arrangement may be provided on a fixed part or on rotating part of the centrifugal compressor, with any shape including herringbone, tilting pad, foil bearing, grooves . . . .

According to an embodiment of the invention, the thrust bearing arrangement includes a thrust bearing member arranged on the outer surface of the drive shaft, the thrust bearing member extending substantially radially outwardly with respect to the drive shaft.

According to an embodiment of the invention, the thrust bearing member is annular.

According to an embodiment of the invention, the thrust bearing member is integrally formed with the drive shaft.

According to an embodiment of the invention, the thrust bearing member has a first thrust bearing surface and a second thrust bearing surface opposite to the first thrust bearing surface.

According to an embodiment of the invention, the first thrust bearing surface of the thrust bearing member is configured to cooperate with a first thrust bearing surface defined by a first thrust bearing element connected to the hermetic housing, and the second thrust bearing surface of the thrust bearing member is configured to cooperate with a second thrust bearing surface defined by a second thrust bearing element connected to the hermetic housing.

According to an embodiment of the invention, the first and second thrust bearing elements are annular.

According to an embodiment of the invention, the first and second impellers are integrally formed with the drive shaft. According to another embodiment of the invention, the first and second impellers are provided on an impeller member secured to the drive shaft, and for example to the first axial end portion of the drive shaft.

According to an embodiment of the invention, the front-side of each of the first and second impellers includes a plurality of blades configured to accelerate, during rotation of the drive shaft, the refrigerant entering the respective compression stage. According to an embodiment of the invention, the plurality of blades of each of the first and second impellers is configured to deliver the accelerated refrigerant to a diffuser arranged at the radial outside edge of the respective impeller.

According to an embodiment of the invention, each of the first and second compression stages includes a fluid inlet and a fluid outlet, the fluid outlet of the first compression stage being fluidly connected to the fluid inlet of the second compression stage.

According to an embodiment of the invention, the radial bearing arrangement is configured to cooperate with an outer surface of the drive shaft.

According to an embodiment of the invention, at least one of the radial bearing arrangement and the thrust bearing arrangement includes a gas bearing. Therefore, a compressed gas at intermediate or high pressure is delivered to a space provided between the corresponding adjacent bearing surfaces of the thrust bearing arrangement and/or of the radial bearing arrangement. Hereby, the use of lubricant oil and associated problems with oil supply, oil temperature or oil circulation in the refrigerant compression can be avoided.

According to an embodiment of the invention, the radial bearing arrangement is a gas radial bearing arrangement.

According to an embodiment of the invention, the thrust bearing arrangement is a gas thrust bearing arrangement.

According to an embodiment of the invention, the centrifugal compressor is configured so that at least a part of the refrigerant compressed in the first and second compression stages is used as lubricating fluid in the gas radial bearing arrangement and/or the fluid thrust bearing arrangement. According to said embodiment of the invention, the centrifugal compressor may be considered as a mono-fluid compressor. This configuration of the centrifugal compressor avoids a separate supply of lubricating fluid and thus reduces costs.

According to an embodiment of the invention, the first and second impellers are non-shrouded impellers.

According to an embodiment of the invention, the inlet diameter of the first impeller is different from the inlet diameter of the second impeller.

According to an embodiment of the invention, the inlet diameter of the first impeller is higher than the inlet diameter of the second impeller.

According to an embodiment of the invention, the inlet diameter of the first impeller is higher than the minimal diameter of the inter-stage sealing arrangement, and the minimal diameter of the inter-stage sealing arrangement is higher than the inlet diameter of the second impeller.

According to an embodiment of the invention, the inlet diameter of the second impeller is higher than the inlet diameter of the first impeller.

These and other advantages will become apparent upon reading the following description in view of the drawing attached hereto representing, as non-limiting examples, embodiments of the centrifugal compressor according to the invention.

BRIEF DESCRIPTION OF THE DRAWINGS

The following detailed description of several embodiments of the invention is better understood when read in conjunction with the appended drawings being understood, however, that the invention is not limited to the specific embodiment disclosed.

DETAILED DESCRIPTION

Figure 1:
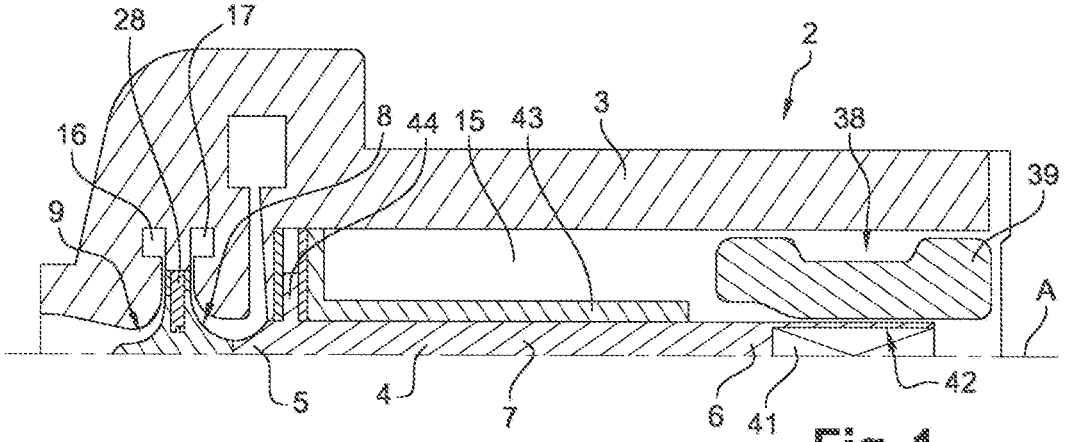
FIG. 1 is a partial longitudinal sectional view of a centrifugal compressor according to the invention.
Figure 2:
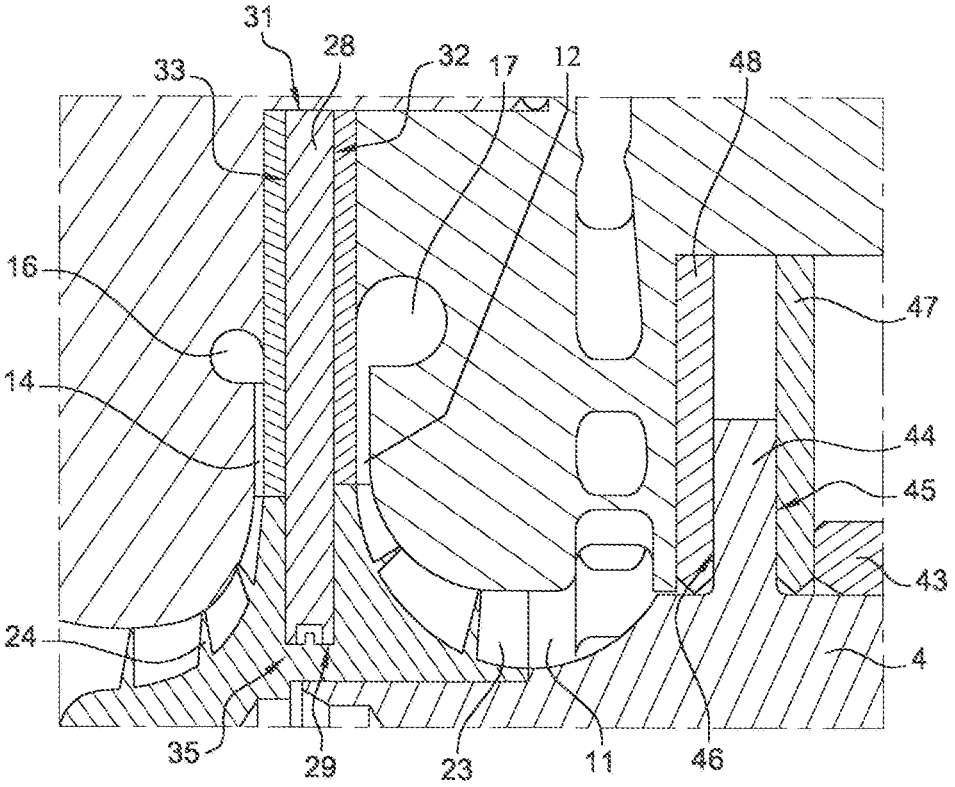
FIGS. 2 to 5 are enlarged sectional views of details of the centrifugal compressor of FIG. 1.
Figure 3:
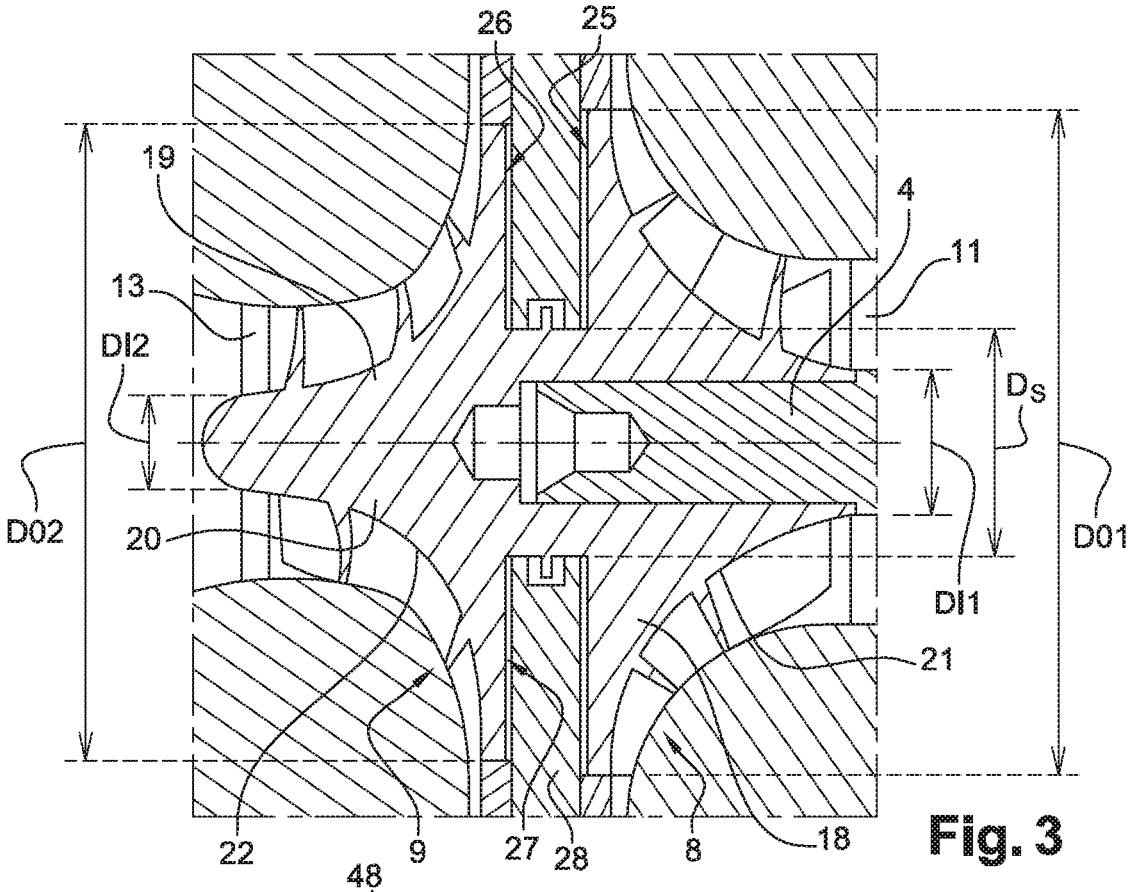
Figure 4:
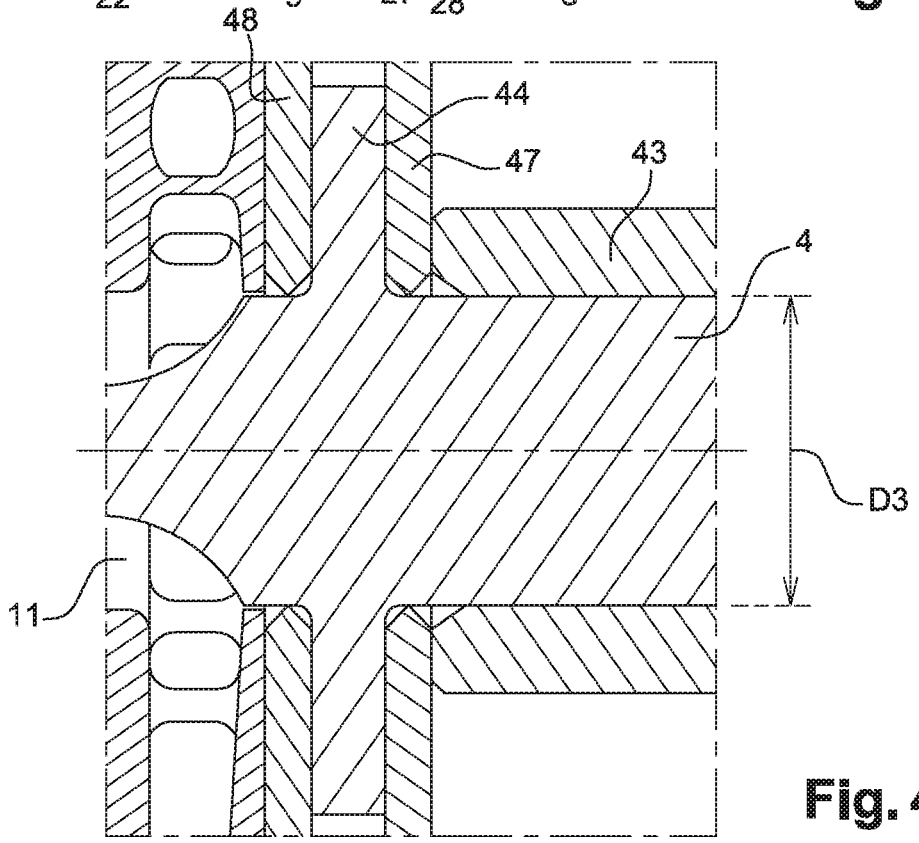
Figure 5:
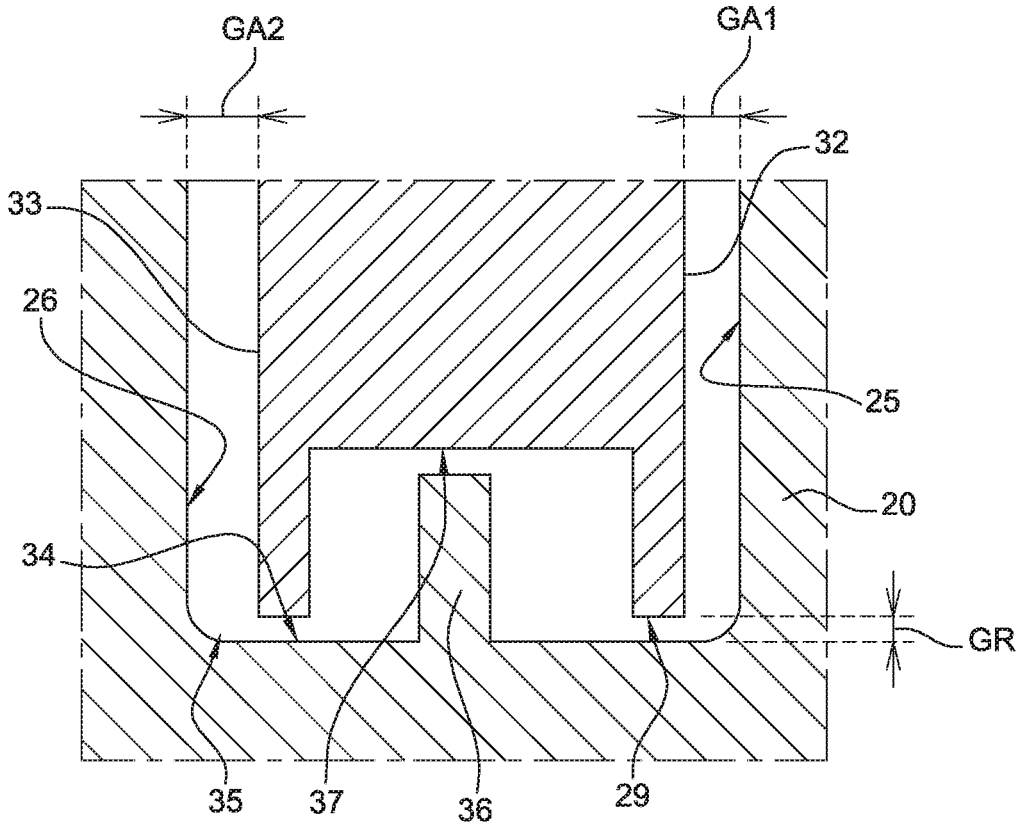

FIGS. 1 to 5 represent a centrifugal compressor 2, and particularly a two-stage centrifugal refrigeration compressor.

The centrifugal compressor 2 includes a hermetic housing 3, and a drive shaft 4 rotatably arranged within the hermetic housing 3 and extending along a longitudinal axis A. The drive shaft 4 includes a first axial end portion 5, a second axial end portion 6 opposite to the first axial end portion 5, and an intermediate portion 7 arranged between the first and second end axial portions 5, 6. The drive shaft 4 may be made of high strength steel, ceramic materials, or combinations thereof.

The centrifugal compressor 2 further includes a first compression stage 8 and a second compression stage 9 configured to compress a refrigerant. The first compression stage 8 includes a fluid inlet 11 and a fluid outlet 12, while the second compression stage 9 includes a fluid inlet 13 and a fluid outlet 14, the fluid outlet 12 of the first compression stage 8 being fluidly connected to the fluid inlet 13 of the second compression stage 9.

The hermetic housing 3 includes therefore a low pressure chamber 15 located upstream the first compression stage 8, a high pressure chamber 16 located downstream the second compression stage 9, and an intermediate pressure chamber 17 provided between the fluid outlet 12 of the first compression stage 8 and the fluid inlet 13 of the second compression stage 9.

The first and second compression stages 8, 9 respectively include a first impeller 18 and a second impeller 19. The first and second impellers 18, 19 are connected to the first axial end portion 5 of the drive shaft 4. According to the embodiment shown on the figures, the first and second impellers 18, 19 are provided on an impeller member 20 secured to the first axial end portion 5 of the drive shaft 4. However, according to another embodiment of the invention, the first and second impellers 18, 19 may be integrally formed with the drive shaft 4.

The first and second impellers 18, 19 are arranged in a back-to-back configuration, so that the directions of fluid flow at the flow inlet 11, 13 of the first and second compression stages 8, 9 are opposite to each other.

Each of the first and second impellers 18, 19 includes a front-side 21, 22 equipped with a plurality of blades 23, 24 configured to accelerate, during rotation of the drive shaft 4, the refrigerant entering the respective one of the first and second compression stages 8, 9, and to deliver the accelerated refrigerant to a diffuser arranged at the radial outside edge of the respective one of the first and second impellers 18, 19. Each of the first and second impellers 18, 19 also includes a back-side 25, 26 extending advantageously substantially perpendicularly to the drive shaft 4.

According to the embodiment shown on the figures, the outer diameters DO1, DO2 of the first and second impellers 18, 19 are substantially equal. It should be noted that the outer diameters DO1, DO2 correspond respectively to the outlet diameters of the first and second impellers 18, 19, i.e. the maximal outer diameters of the first and second impellers 18, 19.

Further, according to the embodiment shown on the figures, the inlet diameter DI1 of the first impeller 18 is higher than the inlet diameter DI2 of the second impeller 19. It should be noted that the inlet diameter DI1 corresponds to the blade root diameter at the front ends of the blades 23, and thus to the hub diameter at the front ends of the blades 23. It should also be noted that the inlet diameter DI2 corresponds to the blade root diameter at the front ends of the blades 24, and thus to the hub diameter at the front ends of the blades 24.

The centrifugal compressor 2 also includes a radial annular groove 27 formed between the back-sides 25, 26 of the first and second impellers 18, 19. According to the embodiment shown on the figures, the radial annular groove 27 is provided on the impeller member 20.

The centrifugal compressor 2 includes a separating member 28 connected to the hermetic housing 3, and having a disc shape. The separating member 28 is at least partially arranged within the radial annular groove 27, and extends substantially perpendicularly to the drive shaft 4. The separating member 28 has an inner peripheral surface 29, an outer peripheral surface 31, a first axial wall surface 32 and a second axial wall surface 33 opposite to the first axial wall surface 32.

The first axial wall surface 32 and the back-side 25 of the first impeller 18 define a first axial gap GA1 and the second axial wall surface 33 and the back-side 26 of the second impeller 19 define a second axial gap GA2. The inner peripheral surface 29 of the separating member 28 and a circumferential bottom surface 34 of the radial annular groove 27 define a radial gap GR.

Advantageously, the width of the first axial gap GA1 is at least twice the width of the radial gap GR, and the width of the second axial gap GA2 is at least twice the width of the radial gap GR. According to an embodiment of the invention, each of the first and second axial gaps GA1, GA2 may be between 140 and 150 μm, and is for example about 150 μm. Advantageously, each of the first and second axial gaps GA1, GA2 is larger than the maximum allowed axial movement of the drive shaft 4 during operation of the centrifugal compressor. According to an embodiment of the invention, the radial gap GR may be between 40 and 50 μm.

The centrifugal compressor 2 includes a circular inter-stage sealing arrangement 35 provided between the first and second compressor stages 8, 9 and in the radial annular groove 27. The circular inter-stage sealing arrangement 35 is configured to minimize or control fluid flow from the high pressure chamber 16 to the intermediate pressure chamber 17. The inter-stage sealing arrangement 35 is formed by the inner peripheral surface 29 of the separating member 28 and the circumferential bottom surface 34 of the radial annular groove 27.

The minimal diameter Ds of the inter-stage sealing arrangement 35 is advantageously less than half of the outer diameter DO1 of the first impeller 18 and is advantageously less than half of the outer diameter DO2 of the second impeller 19.

According to the embodiment shown on the figures, the circular inter-stage sealing arrangement 35 is a labyrinth sealing arrangement. To this end, the impeller member 20 includes a circumferential protrusion 36 extending from the circumferential bottom surface 24 of the radial annular groove 27, the circumferential protrusion 36 being received in an annular recess 37 provided in the inner peripheral surface 29 of the separating member 28.

The centrifugal compressor 2 includes an electrical motor 38 configured to drive in rotation the drive shaft 4 about the longitudinal axis A. The electrical motor 38 includes a stator 39 and a rotor 41. The electrical motor 38 is advantageously arranged in the low pressure chamber 15 defined by the hermetic housing 3.

The rotor 41 is connected to the second axial end portion 6 of the drive shaft 4. To this end, the second axial end portion 6 of the drive shaft 4 may include a central axial bore 42 within which is arranged the rotor 41. The rotor 41 may for example be firmly fitted, such as press-fitted, within the central axial bore 42.

The centrifugal compressor 2 includes a radial bearing arrangement arranged in the low pressure chamber 15 and configured to rotatably support the drive shaft 4. The radial bearing arrangement includes a radial bearing 43 surrounding the drive shaft 4 and configured to cooperate with the outer surface of the drive shaft 4. The radial bearing 43 may be a fluid radial bearing, and for example a gas radial bearing. According to the embodiment shown on the figures, the radial bearing 43 extends along the second axial end portion 6 and along a part of the intermediate portion 7 of the drive shaft 4. Advantageously, the minimal diameter Ds of the inter-stage sealing arrangement 35 is smaller than the outer diameter D3 of the portion of the drive shaft 4 rotatably supported by the radial bearing arrangement.

According to another embodiment of the invention, the radial bearing arrangement may include a plurality of radial bearings distributed along the axial length of the drive shaft 4.

The centrifugal compressor 2 further includes a thrust bearing arrangement arranged in the low pressure chamber 15 and configured to limit an axial movement of the drive shaft 4 during operation. The thrust bearing arrangement may be a fluid thrust bearing arrangement, and for example a gas thrust bearing arrangement.

The thrust bearing arrangement includes an annular thrust bearing member 44 arranged on the outer surface of the intermediate portion 7 of the drive shaft 7, and located between the electric motor 38 and the first compression stage 8. The thrust bearing member 44 may be integrally formed with the drive shaft 4, or may be secured to the latter.

The thrust bearing member 44 extends radially outwardly with respect to the intermediate portion 7 of the drive shaft 4, and has a first thrust bearing surface 45 and a second thrust bearing surface 46 opposite to the first thrust bearing surface 45. The first thrust bearing surface 45 of the thrust bearing member 44 is configured to cooperate with a first thrust bearing surface defined by a first annular thrust bearing element 47 connected to the hermetic housing 3, while the second thrust bearing surface 46 of the thrust bearing member 44 is configured to cooperate with a second annular thrust bearing surface defined by a second thrust bearing element 48 connected to the hermetic housing 3.

According to an embodiment of the invention, the centrifugal compressor 2 is configured so that a part of the refrigerant compressed by the first and second compression stages 8, 9 is used as lubricating fluid in the fluid radial bearing arrangement and the fluid thrust bearing arrangement.

It should be noted that, in use, the volume delimited between the back-side 26 of the second impeller 19 and the second axial wall surface 33 of the separating member 28 is at high pressure ($P_2$), while the volume delimited between the back-side 25 of the first impeller 18 and the first axial wall surface 32 of the separating member 28 is at intermediate pressure ($P_1$). As the outer diameters DO1, DO2 of the first and second impellers 18, 19 are almost equal, the gas force acting on the back-side 26 of the second impeller 19 (due to the high pressure volume) exceeds the force acting on the back-side 25 of the first impeller 18 (due to the intermediate pressure volume). Thus the resulting force Fs acting on the shaft/impeller unit due to the inter-stage sealing arrangement 35 is acting in a first direction away from the electric motor 38. The resulting force Fs is calculated using the following formula:

$$Fs=P_2*\pi/4*(DO2^2-Ds^2)-P_1*\pi/4*(DO1^2-Ds^2),$$

where

DO1 is the outer diameter of the first impeller 18;

DO2 is the outer diameter of the second impeller 19; and

Ds is the minimal diameter of the inter-stage sealing arrangement 35.

Further, gas forces Fi1 acting on the front-side 21 of the first impeller 18 and gas forces Fm acting on an axial end face of the rotor 42 are also acting in the first direction.

Forces acting in a second direction opposite to the first direction, i.e. towards the electric motor 38, are the gas forces Fi2 acting on the front-side 22 of the second impeller 19 and the gas forces Fr acting on other axial surfaces of the drive shaft 4 pointing towards the electric motor 38.

For each operating point of the centrifugal compressor 2, the thrust force Ft acting on the thrust bearing surfaces 45, 46 of the thrust bearing member 44 can be calculated as:

$$Ft=Fs+Fi1+Fm-Fi2-Fr.$$

The thrust force Ft can act in both axial directions, depending on the pressure conditions at different points within the operating map of the centrifugal compressor.

As the thrust force Ft can be calculated based on the resulting force Fs which can be calculated based on the minimal diameter of the inter-stage sealing arrangement 35, the Applicant has identified that, by optimizing the minimal diameter Ds of the inter-stage sealing arrangement 35, it is possible to minimize the amplitude of the axial load applying on the thrust bearing arrangement during operation of the centrifugal compressor 2. Such an optimization of the minimal diameter Ds of the inter-stage sealing arrangement 35 allows to reduce the size of the thrust bearing member 44, and thus the power consumption of the centrifugal compressor 2.

Of course, the invention is not restricted to the embodiments described above by way of non-limiting examples, but on the contrary it encompasses all embodiments thereof.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A centrifugal compressor including:

an hermetic housing, a drive shaft rotatably arranged within the hermetic housing, a first and a second compression stage configured to compress a refrigerant, the first and second compression stages respectively including a first and a second impeller, each of the first and second impellers having a front-side and a back-side, the first and second impellers being connected to the drive shaft and being arranged in a back-to-back configuration, a radial annular groove formed between the back-sides of the first and second impellers, a circular inter-stage sealing arrangement provided between the first and second compressor stages and in the radial annular groove, a radial bearing arrangement configured to rotatably support the drive shaft, and a thrust bearing arrangement configured to limit an axial movement of the drive shaft during operation, wherein the diameter of the inter-stage sealing arrangement is configured to minimize the amplitude of the axial load applying on the thrust bearing arrangement during operation of the centrifugal compressor, wherein the minimal diameter of the inter-stage sealing arrangement is smaller than the outer diameter of the portion of the drive shaft rotatably supported by the radial bearing arrangement.

2. The centrifugal compressor according to claim 1, wherein the minimal diameter of the inter-stage sealing arrangement is less than half of the outer diameter of the first impeller and is less than half of the outer diameter of the second impeller.

3. The centrifugal compressor according to claim 1, further including a separating member connected to the hermetic housing, the separating member having a disc shape and being at least partially arranged within the radial annular groove, the inter-stage sealing arrangement being formed by an inner peripheral surface of the separating member and a circumferential bottom surface of the radial annular groove.

4. The centrifugal compressor according to claim 3, wherein the separating member has a first axial wall surface and a second axial wall surface opposite to the first axial wall surface, the first axial wall surface and the back-side of the first impeller defining a first axial gap and the second axial wall surface and the back-side of the second impeller defining a second axial gap.

5. The centrifugal compressor according to claim 3, wherein the inner peripheral surface of the separating member and the circumferential bottom surface of the radial annular groove define a radial gap.

6. The centrifugal compressor according to claim 4, wherein the width of the first axial gap is at least twice the width of the radial gap, and the width of the second axial gap is at least twice the width of the radial gap.

7. The centrifugal compressor according to claim 1, wherein the hermetic housing includes a low pressure chamber located upstream the first compression stage, a high pressure chamber located downstream the second compression stage, and an intermediate pressure chamber provided between a fluid outlet of the first compression stage and a fluid inlet of the second compression stage.

8. The centrifugal compressor according to claim 7, wherein the circular inter-stage sealing arrangement is configured to minimize or control fluid flow from the high pressure chamber to the intermediate pressure chamber.

9. The centrifugal compressor according to claim 7, wherein the radial bearing arrangement and the thrust bearing arrangement are arranged in the low pressure chamber.

10. The centrifugal compressor according to claim 1, wherein the circular inter-stage sealing arrangement is a labyrinth sealing arrangement.

11. The centrifugal compressor according to claim 1, wherein the outer diameters of the first and second impellers are substantially equal.

12. The centrifugal compressor according to claim 1, further including a driving device configured to drive in rotation the drive shaft about a rotation axis, the radial bearing arrangement and the thrust bearing arrangement being located between the driving device and the first compression stage.

13. The centrifugal compressor according to claim 1, wherein the thrust bearing arrangement includes a thrust bearing member arranged on the outer surface of the drive shaft, the thrust bearing member extending substantially radially outwardly with respect to the drive shaft.

14. The centrifugal compressor according to claim 1, wherein at least one of the radial bearing arrangement and the thrust bearing arrangement includes a gas bearing.

15. The centrifugal compressor according to claim 1, wherein an inlet diameter of the first impeller is larger than an inlet diameter of the second impeller.

16. The centrifugal compressor according to claim 2, further including a separating member connected to the hermetic housing, the separating member having a disc shape and being at least partially arranged within the radial annular groove, the inter-stage sealing arrangement being formed by an inner peripheral surface of the separating member and a circumferential bottom surface of the radial annular groove.

17. The centrifugal compressor according to claim 4, wherein the inner peripheral surface of the separating member and the circumferential bottom surface of the radial annular groove define a radial gap.

18. The centrifugal compressor according to claim 5, wherein the width of the first axial gap is at least twice the width of the radial gap, and the width of the second axial gap is at least twice the width of the radial gap.

19. The centrifugal compressor according to claim 2, wherein the hermetic housing includes a low pressure chamber located upstream the first compression stage, a high pressure chamber located downstream the second compression stage, and an intermediate pressure chamber provided between a fluid outlet of the first compression stage and a fluid inlet of the second compression stage.

* * * * *